US006220898B1

(12) United States Patent
Wu

(10) Patent No.: US 6,220,898 B1
(45) Date of Patent: Apr. 24, 2001

(54) AUDIO JACK HAVING MEANS FOR RELIABLY SECURING TERMINALS THEREOF

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/295,973

(22) Filed: Apr. 21, 1999

(30) Foreign Application Priority Data

Oct. 17, 1998 (TW) ..... 87217149

(51) Int. Cl.[7] ..... H01R 24/04
(52) U.S. Cl. ..... 439/668; 439/188
(58) Field of Search ..... 439/668, 188, 439/83

(56) References Cited

U.S. PATENT DOCUMENTS 4,392,708 * 7/1983 Bailey et al. ..... 439/668
4,659,167 * 4/1987 Masuda ..... 439/668
5,919,052 * 7/1999 Ho ..... 439/83
6,056,602 * 5/2000 Wu ..... 439/668

* cited by examiner

*Primary Examiner*—Khiem Nguyen
*Assistant Examiner*—Michael C. Zarroli
(74) *Attorney, Agent, or Firm*—Wei Te Chung

(57) ABSTRACT

An audio jack includes a casing member defining an interior space having an opening. A cover is fixed to the casing member to seal the opening. Two sets of conductive terminal members are fixed in the interior space. Each set has a stationary member and a movable member that engages with the stationary member and is selectively disengageable therefrom. A plug receptacle is formed on the casing member for reception of a plug. A passage is defined inside the casing member for guiding the insertion of the plug. The insertion of the plug into the interior space establishes physical/electrical engagement with the movable members and forces the movable members to disengage from the stationary members. The cover has a barb engaging an opening defined in the casing and two resilient legs having barbed ends engaging shoulders formed on the casing thereby securely fixing the cover to the casing member. A positioning pin is provided on the cover to be forcibly fit into a hole defined in the casing member.

14 Claims, 6 Drawing Sheets

AUDIO JACK HAVING MEANS FOR RELIABLY SECURING TERMINALS THEREOF

BACKGROUND OF THE INVENTION

1. Field of the Invention

The present invention generally relates to an electrical connector, and in particular to an audio jack type connector for transmitting audio signals.

2. The Prior Art

As the computer and information industries develop, the transmission frequency of audio signals increases in computer and information processing systems. Electrical connectors are developed to facilitate transmission of such high frequency audio signals. Examples of such connectors are disclosed in U.S. Pat. No. 5,075,518 and Japanese patent publication No. 5-90863. The device of U.S. Pat. No. 5,075,518 includes three conductive terminal members for electrically engaging a mating connector and comprises a complicated structure. The Japanese patent discloses an audio jack having five conductive terminal members that are not securely arranged therein.

It is thus desirable to have an audio jack with a simple structure capable for effectively securing conductive terminal members therein.

SUMMARY OF THE INVENTION

Accordingly, an object of the present invention is to provide an audio jack having a simple structure.

Another object of the present invention is to provide an audio jack having conductive terminal members securely fixed therein.

To achieve the above objects, an audio jack in accordance with the present invention comprises a casing member defining an interior space having an opening. A cover is fixed to the casing member to seal the opening. Two sets of conductive terminal members are fixed in the interior space. Each set has a stationary member and a movable member that engages with the stationary member and is selectively disengageable therefrom. A plug receptacle is formed on the casing member for reception of a plug. A passage is defined inside the casing member for guiding the insertion of the plug. The insertion of the plug into the interior space establishes physical/electrical engagement with the movable members and forces the movable members to disengage from the stationary members. The cover has a barb engaging an opening defined in the casing and two resilient legs having barbed ends engaging shoulders formed on the casing thereby securely fixing the cover to the casing member. A positioning pin is provided on the cover to be forcibly fit into a hole defined in the casing member.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
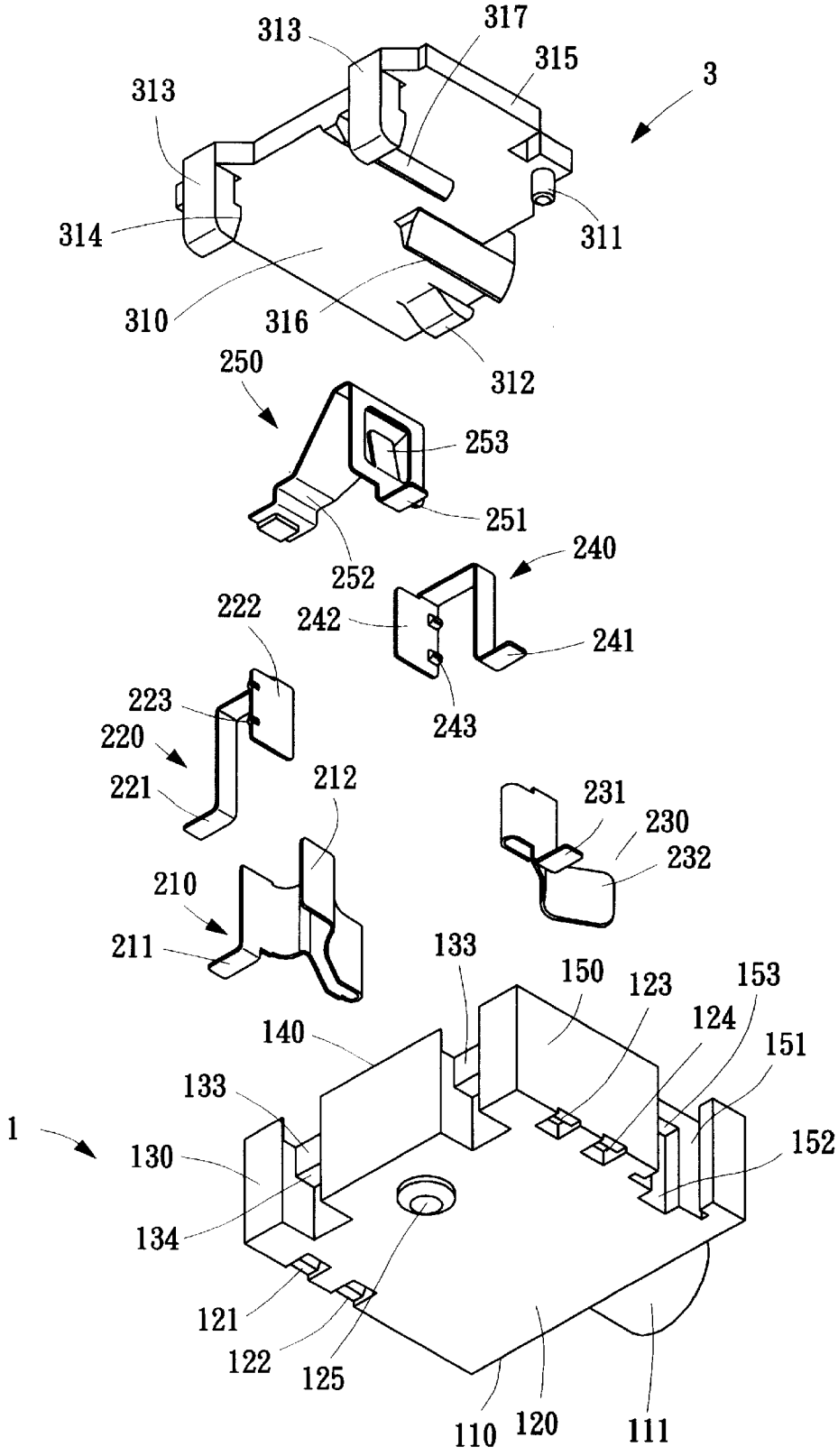
FIG. 1 is an exploded view of an audio jack constructed in accordance with the present invention.
Figure 2:
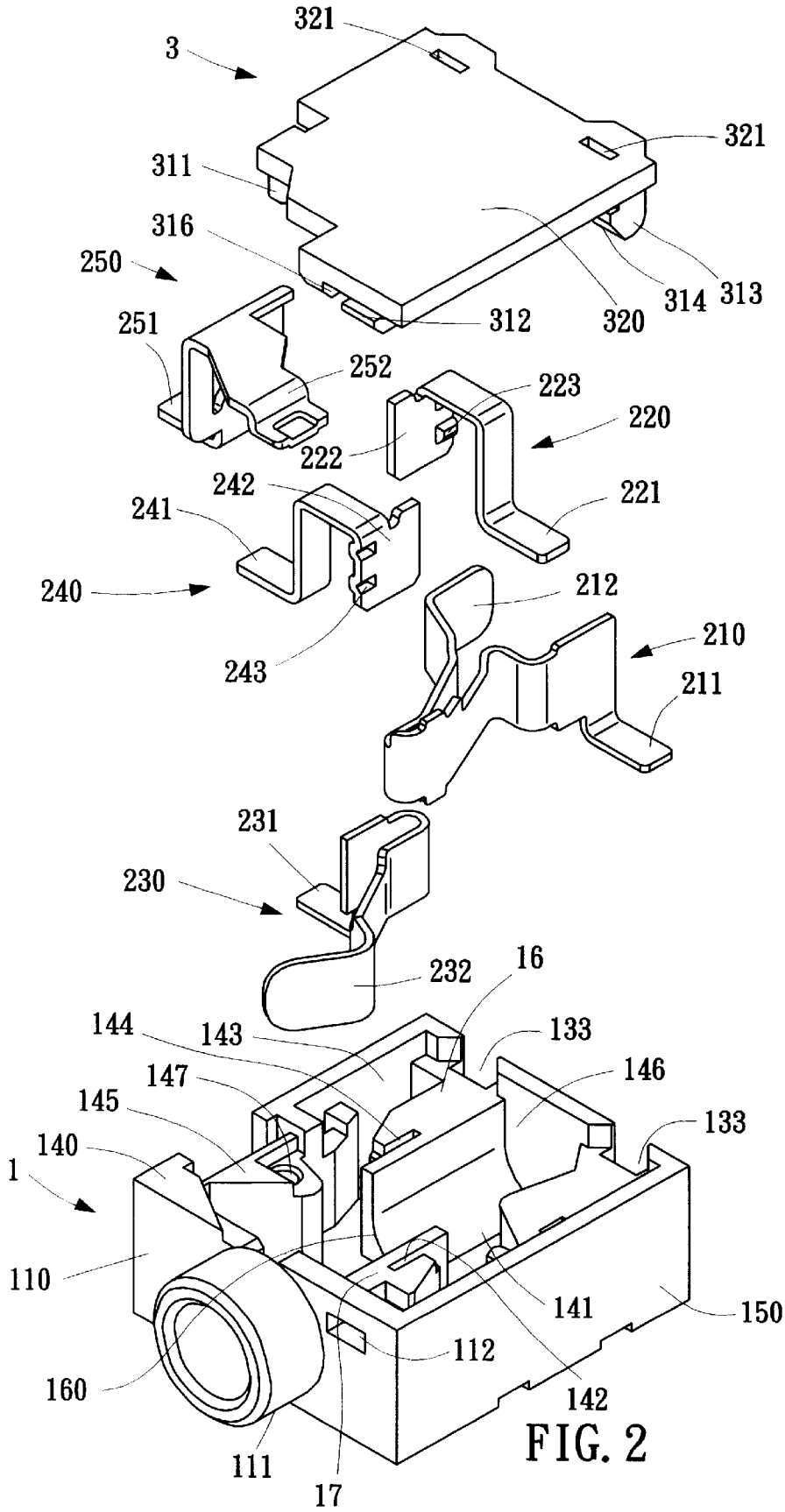
FIG. 2 is another exploded view of the audio jack of the present invention taken from a different perspective.

Referring to the drawings and in particular to FIGS. 1 and 2, wherein an audio jack constructed in accordance with the present invention is shown, the audio jack of the present invention comprises a first casing member 1 and a second casing member 3, both made of nonconductive material. The first casing member 1 has a bottom face 120 having four edges from which a front wall 110, a rear wall 130 and two lateral walls 150 extend. An interior space 146 is defined between the walls 110, 120, 130, 150. The first casing member 1 also has a top face 140 forming an opening of the interior space 146.

The front wall 110 has a plug receptacle 111 formed thereon for reception of a plug (not shown) for the transmission of audio signals. The plug receptacle 111 is in communication with the interior space 146. The bottom wall 120 of the first casing member 1 has a projection 125 formed thereon. The projection 125 is receivable in a hole formed on a substrate (not shown) for positioning purposes.

Figure 3:
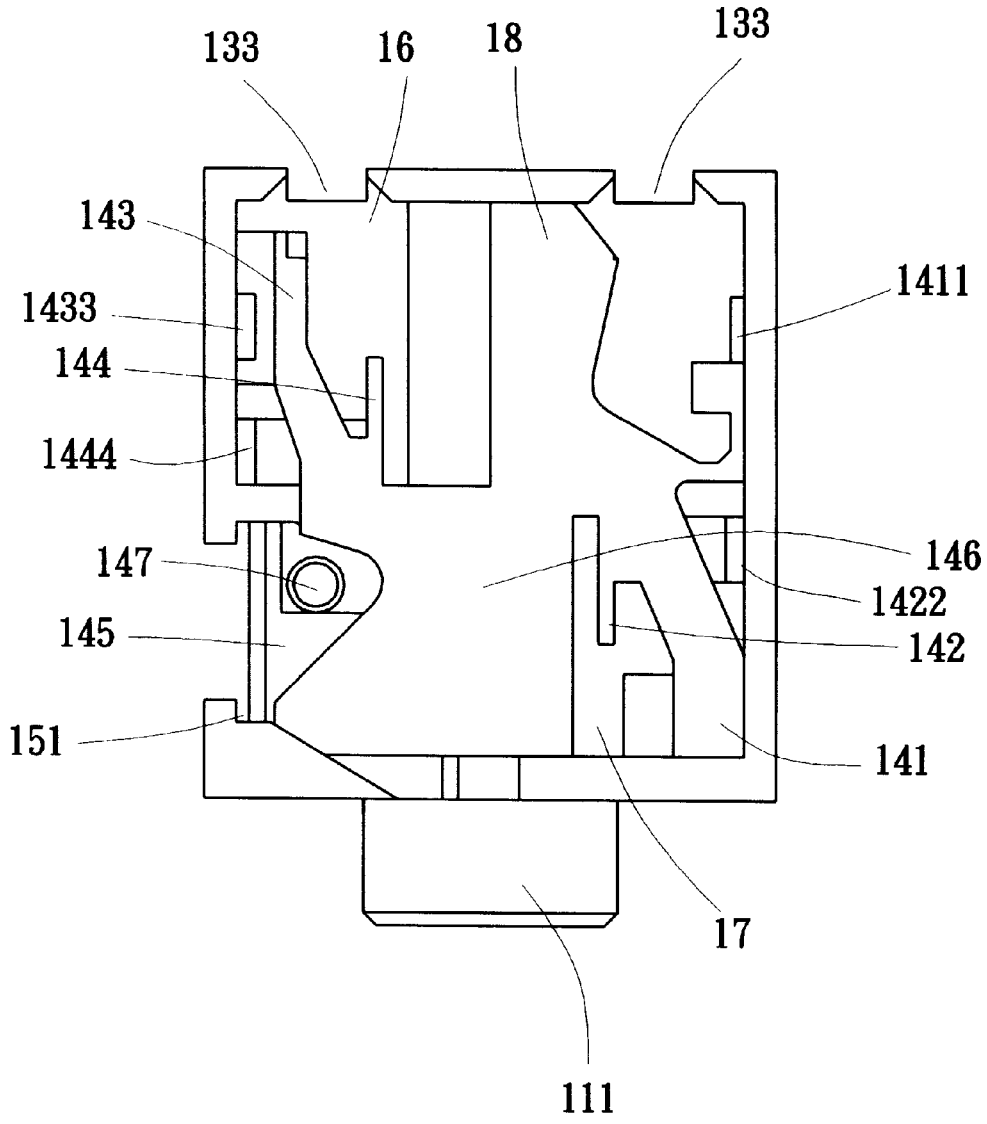
FIG. 3 is a top plan view of a first casing member of the audio jack of the present invention.
Figure 4:
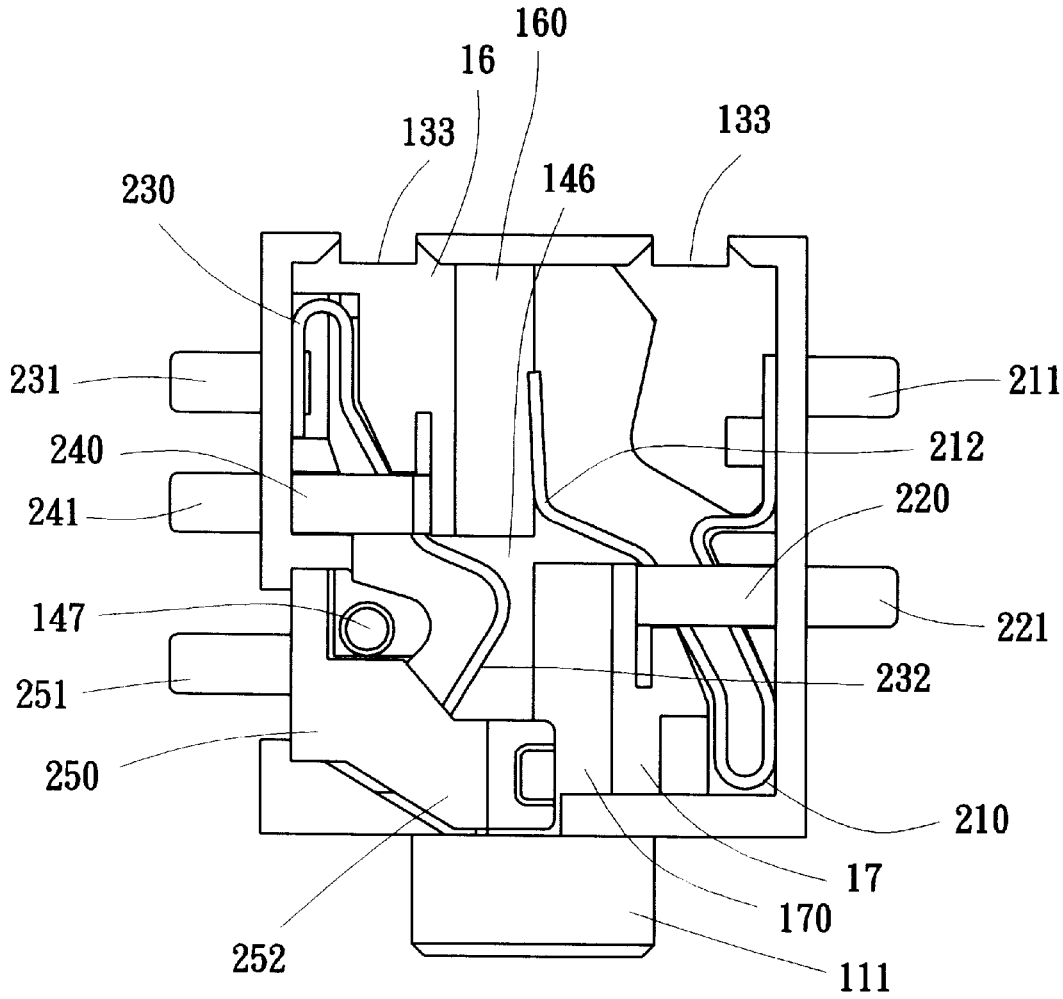
FIG. 4 is a top plan view of the first casing member with conductive terminal members mounted therein.

Also referring to FIGS. 3 and 4, the first casing member 1 has a first terminal holding slot 141, a second terminal holding slot 142, a third terminal holding slot 143 and a fourth terminal holding slot 144 defined in the interior space 146 for respectively receiving and retaining a first conductive terminal member 210, a second conductive terminal member 220, a third conductive terminal member 230 and a fourth conductive terminal member 240 therein.

The first terminal member 210 is U-shaped and has a first limb and a second limb from which an internal contact section 212 and an external contact section 211 extend, respectively. The external contact section 211 extends out of the interior space 146 through a first channel 1411 defined in the first casing member 1 and projects beyond the first casing member 1 via an opening 121 of the first channel 1411 defined in the bottom face 120.

The second terminal member 220 is U-shaped and has a first limb forming an internal contact section 222 and a second limb having an external contact section 221 extending therefrom. The internal contact section 222 is received in the second terminal holding slot 142. The second limb of the second terminal member 220 is received in a second channel 1422 defined in the first casing member 1 and the external contact section 221 projects beyond the first casing member 1 via an opening 122 of the second channel 1422 defined in the bottom wall 120.

The first limb of the first terminal member 210 is resilient and biases the internal contact section 212 to engage with the internal contact section 222 of the second terminal member 220. Preferably, the internal contact section 222 comprises a plurality of projections 223 for facilitating electrical engagement between the internal contact sections 212, 222 of the first and section terminal members 210, 220. In this respect, the first terminal member 210 may be regarded as a movable member, while the second terminal member 220 is a stationary member. The movable member 210 is selectively separated from and electrically disengaged from the stationary member 220.

The third terminal member 230 is U-shaped and has a first limb from which an internal contact section 232 extends and a second limb from which an external contact section 231 extends. The external contact section 231 extends out of the interior space 146 though a third channel 1433 defined in the first casing member 1 and projects beyond the first casing member 1 via an opening 123 of the third channel 1433 defined in the bottom wall 120.

The fourth terminal member 240 is U-shaped and has a first limb forming an internal contact section 242 and a second limb having an external contact section 241 extending therefrom. The internal contact section 242 is received in the fourth terminal holding slot 144. The second limb of the fourth terminal member 240 is received in a fourth channel 1444 defined in the first casing member 1 and the external contact section 241 projects beyond the first casing member 1 via an opening 124 of the fourth channel 1444 defined in the bottom wall 120.

The first limb of the third terminal member 230 is resilient and biases the internal contact section 232 to engage with the internal contact section 242 of the fourth terminal member 240. Preferably, the internal contact section 242 comprises a plurality of projections 243 for facilitating electrical engagement between the internal contact sections 232, 242 of the third and fourth terminal members 230, 240. Similarly, the third terminal member 230 may be regarded as a movable member, while the fourth terminal member 240 is a stationary member. The movable member 230 is selectively separated from and electrically disengaged from the stationary member 240.

In the embodiment illustrated, the first casing member 1 comprises two solid portions 16, 17 formed in the interior space 146 and spaced from each other to define a central passage 18 therebetween. The first and second terminal holding slots 141, 142 are defined in the solid portion 16 and the third and fourth terminal holding slots 143, 144 are defined in the solid portion 17. The central passage 18 is substantially aligned and in communication with the plug receptacle 111 for accommodating the insertion of the plug. The internal contact sections 212, 232 of the first and third terminal members 210, 230 partially project into the central passage 18. Thus, the insertion of the plug actuates engagement between the plug and the first and third terminal members 210, 230 and deflects the first limbs of the first and third terminal members 210, 230 whereby the internal contact sections 212, 232 of the first and third terminal members 210, 230 are separated from the internal contact sections 222, 242 of the second and fourth terminal members 220, 240. Preferably, the solid portions 16, 17 have an arcuate surface 160, 170 bounding the central passage 18 for facilitating insertion of the plug that is usually cylindrical.

A grounding terminal member 250 is U-shaped and fits over an internal wall 145 formed inside the interior space 146. The grounding terminal 250 has an internal contact section 252 extending from a first limb thereof. The internal contact section 252 extends into the central passage 18 for contacting the plug. The grounding terminal member 250 also has a second limb from which an external contact section 251 extends. The external contact section 251 projects out of the first casing member 1.

In the embodiment illustrated, one of the lateral faces 150 of the first casing member 1 is provided with a slot 151 at a location corresponding to the internal wall 145 for receiving the second limb of the grounding terminal member 250. The slot 151 is preferably T-shaped or dovetail-shaped for securely retaining the second limb of the grounding terminal member 250 therein. A recess 152 is defined in the lateral face 150 in communication with the slot 151 to form a shoulder 153 engageable by an inward barb 253 formed on the second limb of the grounding terminal member 250 for fixing the grounding terminal member 250 on the internal wall 145 of the first casing member 1.

Figure 5:
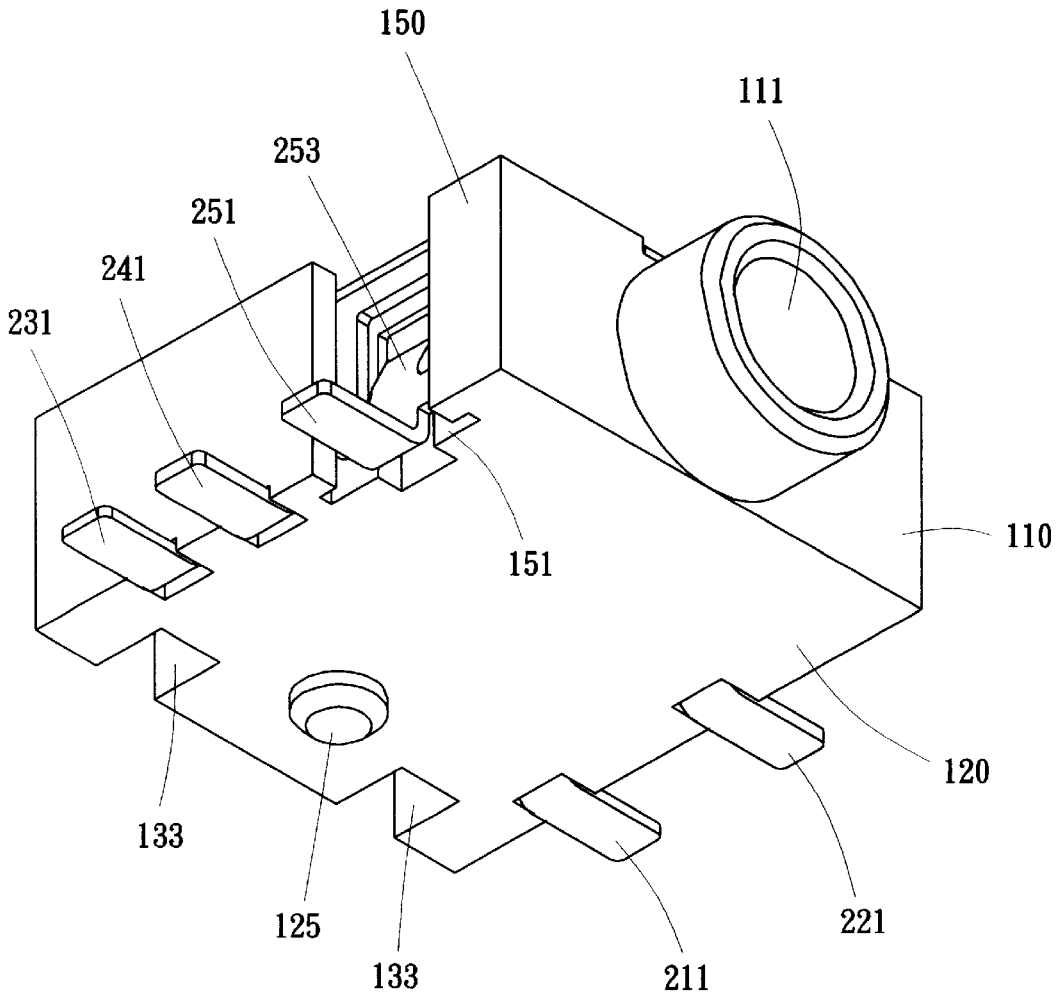
FIG. 5 is an assembled view of FIG. 1.

Also referring to FIG. 5, the external contact sections 211, 221, 231, 241, 251 of the first, second, third, fourth and grounding terminal members 210, 220, 230, 240, 250 that project out of the first casing member 1 are bent and shaped to lie substantially in a common plane thereby allowing the audio jack of the present invention to be surface mounted to a printed circuit board.

The second casing member 3 which serves as a cover for the top opening side of the first casing member 1 is received in the opening of the interior space 146 to substantially seal the interior space 146 and form a continuous surface with the top wall 140 of the first casing member 1. Therefore, a periphery 315 of the second casing member 3 is fittingly engaged in the opening between the front, rear and lateral walls 110, 130, 150 of the first casing member 1.

The second casing member 3 has a bottom side 310 positionable on the solid portions 16, 17 to securely retain the terminal members 210, 220, 230, 240 in position in the terminal holding slots 141, 142, 143, 144. The second casing member 3 also has a top side 320 opposite the bottom side 310. A positioning pin 311 is formed on the bottom side 310. The pin 311 is forcibly fit into a corresponding hole 147 defined in the first casing member 1 for attaching the second casing member 3 to the first casing member 1.

The second casing member 3 comprises a barb 312 and the front wall 110 of the first casing member 1 is provided with an opening 112 for receiving and engaging with the barb 312. The engagement between the periphery 315 of the second casing member 3 and the walls 110, 130, 150 of the first casing member 1, together with the barb 312 engaging the opening 112 of the first casing member 1, effectively prevents relative displacement of the second casing member 3 with respect to the first casing member 1 in a direction substantially parallel to the second casing member 3.

The second casing member 3 also comprises two resilient legs 313 extending from the bottom side 310 thereof. The legs 313 are provided with a barb 314 that engages a corresponding shoulder 134 formed on the rear face 130 of the first casing member 1. Thus, relative displacement of the second casing member 3 with respect to the first casing member I is prevented in a direction substantially normal to the second casing member 3.

Preferably, the rear face 130 is provided with two vertical slots 133 in which the shoulders 134 are formed. The slots 133 receive the legs 313 therein and the barbs 314 engage the shoulders 134. Thus, the second casing member 3 is securely fixed to the first casing member 1. The first casing member 1 and the second casing member 3 together substantially enclose the terminal members 210, 220, 230, 240.

Preferably, the second casing member 3 is provided with two spaced, elongate ribs 316, 317 on the bottom side 310 thereof. The ribs 316, 317 further define the central passage 18 to facilitate insertion of the plug. Preferably, the ribs 316, 317 have arcuate faces corresponding to the arcuate surfaces 160, 170 of the solid portions 16, 17 of the first casing member 1.

Figure 6:
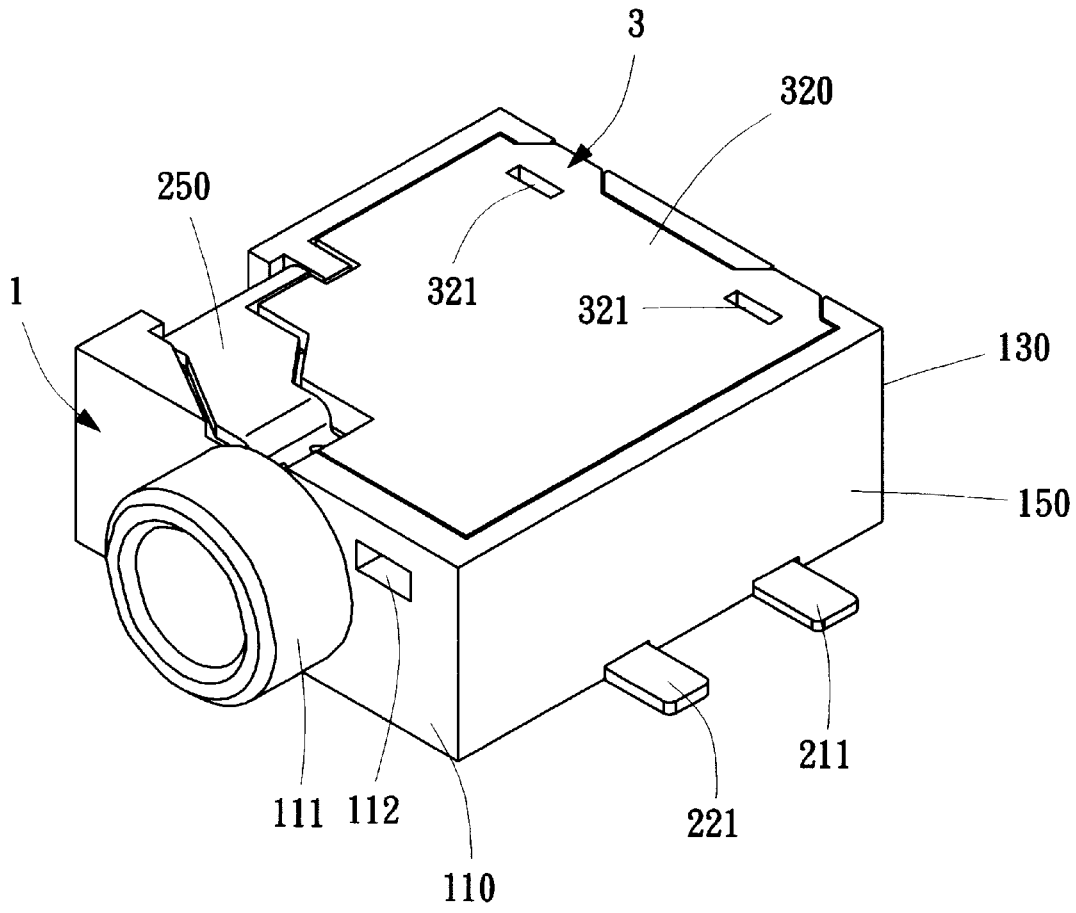
FIG. 6 is an assembled view of FIG. 2.

Preferably, the second casing member 3 is provided with openings 321 (FIGS. 2 and 6) corresponding to each resilient leg 313. The openings 321 allow a user to insert an elongate object (not shown) therein for disengaging the barbs 314 from the shoulders 134 of the first casing member 1.

In the embodiment illustrated, during insertion, the plug first contacts the grounding terminal member 250 and then contacts the internal contact sections 212, 232 of the first and third terminal members 210, 230. Thus, the internal contact sections 212, 232 of the first and third terminal members

210, 230 are separated from the internal contact sections 222, 242 of the second and fourth terminal members 220, 240 thereby disconnecting the first and third terminal members 210, 230 from the second and fourth terminal members 220, 240.

Although the present invention has been described with reference to a preferred embodiment thereof, it is apparent to those skilled in the art that there are a variety of modifications and changes that may be made without departing from the scope of the present invention which is intended to be defined by the appended claims.

What is claimed is:

1. An audio jack comprising;

a nonconductive casing member having a bottom wall from which a front side wall, a rear side wall and two lateral side walls extend to define an interior space, the casing member having a top face defining an opening of the interior space, the front side wall having a bore adapted to receive a plug therein, the casing member comprising two solid portions in the interior space which are spaced from each other to define a central passage extending from the bore of the front side wall for accommodating the plug, each of the solid portions defining two terminal holding slots respectively receiving therein a stationary terminal member and a movable terminal member, the movable terminal member having a deflectable arm which engages with the stationary terminal member and has a portion projecting into the central passage; and a cover having a bottom face, the cover being received in the opening of the top face of the casing member with the bottom face supported on top sides of the solid portions to securely retain the terminal members in the corresponding slots, a periphery of the cover being fittingly engaged within an inner periphery of the opening, the bottom face of the cover having a positioning pin extending therefrom for being forcibly fit in a corresponding hole formed in the casing member;

wherein the solid portions comprise arcuate surfaces bounding the central passage.

2. The audio jack as claimed in claim 1, wherein the cover comprises a barb engaging with an opening formed on one of the side walls.

3. The audio jack as claimed in claim 2, wherein the cover further comprises resilient legs extending from the bottom face thereof, each resilient leg having a barbed free end for engaging with a corresponding shoulder formed on a side wall opposite the side wall forming the opening.

4. The audio jack as claimed in claim 1, wherein the cover comprises two elongate ribs formed on the bottom face thereof, the two ribs being spaced from each other to further define the central passage.

5. The audio jack as claimed in claim 4, wherein the solid portions of the casing member and the ribs of the cover have arcuate surfaces bounding the central passage.

6. The audio jack as claimed in claim 1, wherein the casing member comprises a positioning boss formed on a bottom face thereof, the boss being adapted to be received in a hole formed in a substrate.

7. The audio jack as claimed in claim 1, wherein the stationary terminal members each comprise a section received in the corresponding terminal holding slot, the section having projections for providing a secure engagement between the section and the slot.

8. The audio jack as claimed in claim 1, wherein the terminal members have an external contact section extending out of the casing member, the external contact sections lying in a common plane.

9. The audio jack as claimed in claim 1, wherein the casing member comprises an internal wall over which a grounding terminal member is fit, the grounding terminal member having an outside section located in a slot formed in one of the side walls of the casing member, the outside section having an inward barb engaging with a recess formed in the slot.

10. The audio jack as claimed in claim 1, wherein the bore of the front wall defines a plug receptacle which allows the plug to be inserted into the central passage of the casing member.

11. An audio jack comprising:

a nonconductive casing member having a bottom wall from which a front side wall, a rear side wall and two lateral side walls extend to define an interior space, the casing member having a top face defining an opening of the interior space, the front side wall having a bore adapted to receive a plug therein, the casing member comprising two solid portions in the interior space which are spaced from each other to define a central passage extending from the bore of the front side wall for accommodating the plug, each of the solid portions defining two terminal holding slots respectively receiving therein a stationary terminal member and a movable terminal member, the movable terminal member having a deflectable arm which engages with the stationary terminal member and has a portion projecting into the central passage; and a cover having a bottom face, the cover being received in the opening of the top face of the casing member with the bottom face supported on top sides of the solid portions to securely retain the terminal members in the corresponding slots, a periphery of the cover being fittingly engaged within an inner periphery of the opening, the bottom face of the cover having a positioning pin extending therefrom for being forcibly fit in a corresponding hole formed in the casing member;

wherein the cover comprises a barb engaging with an opening formed on one of the side walls and resilient legs extending from the bottom face thereof, each resilient leg having a barbed free end for engaging with a corresponding shoulder formed on a side wall opposite the side wall forming the opening.

12. The audio jack as claimed in claim 11, wherein the side wall opposite the side wall forming the opening has a slot formed thereon for receiving the resilient legs, the shoulders being formed in the slots to be engaged by the barbed ends of the resilient legs.

13. An audio jack comprising:

a nonconductive casing member having a bottom wall from which a front side wall, a rear side wall and two lateral side walls extend to define an interior space, the casing member having a top face defining an opening of the interior space, the front side wall having a bore adapted to receive a plug therein, the casing member comprising two solid portions in the interior space which are spaced from each other to define a central passage extending from the bore of the front side wall for accommodating the plug, each of the solid portions defining two terminal holding slots respectively receiving therein a stationary terminal member and a movable terminal member, the movable terminal member having a deflectable arm which engages with the stationary terminal member and has a portion projecting into the central passage; and a cover having a bottom face, the cover being received in the opening of the top face of the casing member with the bottom face supported on top sides of the solid portions to securely retain the terminal members in the corresponding slots, a periphery of the cover being fittingly engaged within an inner periphery of the opening, the bottom face of the cover having a positioning pin extending therefrom for being forcibly fit in a corresponding hole formed in the casing member;

wherein the cover comprises two elongate ribs formed on the bottom face thereof, the two ribs being spaced from each other to further define the central passage.

14. An audio jack comprising:

a nonconductive casing member having a bottom wall from which a front side wall, a rear side wall and two lateral side walls extend to define an interior space, the casing member having a top face defining an opening of the interior space, the front side wall having a bore adapted to receive a plug therein, the casing member comprising two solid portions in the interior space which are spaced from each other to define a central passage extending from the bore of the front side wall for accommodating the plug, each of the solid portions defining two terminal holding slots respectively receiving therein a stationary terminal member and a movable terminal member, the movable terminal member having a deflectable arm which engages with the stationary terminal member and has a portion projecting into the central passage; and a cover having a bottom face, the cover being received in the opening of the top face of the casing member with the bottom face supported on top sides of the solid portions to securely retain the terminal members in the corresponding slots, a periphery of the cover being fittingly engaged within an inner periphery of the opening, the bottom face of the cover having a positioning pin extending therefrom for being forcibly fit in a corresponding hole formed in the casing member;

wherein the casing member comprises an internal wall over which a grounding terminal member is fit, the grounding terminal member having an outside section located in a slot formed in one of the side walls of the casing member, the outside section having an inward barb engaging with a recess formed in the slot.

* * * * *